US007798324B2

(12) United States Patent
Wojcik

(10) Patent No.: US 7,798,324 B2
(45) Date of Patent: Sep. 21, 2010

(54) SYSTEM AND METHOD FOR PACKAGING CUTTING BLADES

(75) Inventor: Frank A. Wojcik, Toledo, OH (US)

(73) Assignee: Crescent Manufacturing Company, Fremont, OH (US)

( * ) Notice: Subject to any disclaimer, the term of this patent is extended or adjusted under 35 U.S.C. 154(b) by 0 days.

(21) Appl. No.: 11/736,220

(22) Filed: Apr. 17, 2007

(65) Prior Publication Data

US 2008/0257767 A1 Oct. 23, 2008

(51) Int. Cl.
*B65D 85/00* (2006.01)
*B65D 75/28* (2006.01)

(52) U.S. Cl. ..... 206/372; 206/471; 206/461; 206/349

(58) Field of Classification Search ..... 206/349, 206/5.1, 461, 471, 352, 354, 363, 370, 372, 206/373, 557, 562, 524.8, 486
See application file for complete search history.

(56) References Cited

U.S. PATENT DOCUMENTS 1,489,379 A * 4/1924 Zeller ..... 206/208
1,619,081 A 3/1927 McLaurin
2,744,624 A 5/1956 Hoogstoel et al.
2,849,109 A * 8/1958 Rommel ..... 206/352
2,866,542 A 12/1958 Svirchev
3,047,139 A * 7/1962 Jacoff ..... 206/372
3,469,768 A 9/1969 Repko
3,534,887 A 10/1970 Ginsberg
3,596,758 A * 8/1971 Phillips et al. ..... 206/256
3,597,302 A 8/1971 Gerard
3,804,238 A * 4/1974 Howard ..... 206/459.5
3,972,417 A * 8/1976 Iten et al. ..... 206/354
4,095,691 A * 6/1978 Iten ..... 206/354
4,197,947 A * 4/1980 Zaidi ..... 206/438
4,201,297 A 5/1980 Datwyler
4,206,844 A * 6/1980 Thukamoto et al. ..... 206/439
4,285,428 A * 8/1981 Beddall et al. ..... 206/354

(Continued)

OTHER PUBLICATIONS

Photograph showing a plastic blade package produced by Crescent Mfg. Co., incorporating a plurality of blade compartments extending from a non-compartmented, non-sealed portion. The blade compartments are non-separable.

(Continued)

*Primary Examiner*—Mickey Yu
*Assistant Examiner*—Steven A. Reynolds
(74) *Attorney, Agent, or Firm*—James R. Eley; Michael A. Forhan; Eley Law Firm Co.

(57) ABSTRACT

A flexible package for cutting blades. A flexible first layer has at least one cavity formed therein to form a base for receiving a cutting blade. A flexible second layer is arranged over the base and proximate the base. A seal is formed about the periphery of each cavity to encapsulate a cutting blade placed into the cavity, the seal being formed by applying a predetermined combination of heat and pressure to selected portions of the second layer to cause the adhesive thereon to selectively bond to the base. Movement of each encapsulated cutting blade is deterred during transport and handling by the cavity in cooperation with the seal and the second layer, the blades becoming movable within the cavity when the seal is broken.

12 Claims, 10 Drawing Sheets

U.S. PATENT DOCUMENTS

| | | | | |
|---|---|---|---|---|
| 4,321,781 | A * | 3/1982 | Hall | 53/427 |
| 4,681,223 | A * | 7/1987 | Roberts | 206/354 |
| 4,691,820 | A * | 9/1987 | Martinez | 206/205 |
| 5,009,894 | A * | 4/1991 | Hsiao | 424/451 |
| 5,074,416 | A * | 12/1991 | Hustad | 206/524.8 |
| 5,350,059 | A * | 9/1994 | Chester et al. | 206/63.5 |
| 5,375,698 | A * | 12/1994 | Ewart et al. | 206/5.1 |
| 5,697,495 | A * | 12/1997 | Abrams et al. | 206/5.1 |
| 6,029,807 | A * | 2/2000 | Love | 206/0.82 |
| 6,065,646 | A * | 5/2000 | Schwaikert | 222/143 |
| 6,168,026 | B1 * | 1/2001 | Haggard et al. | 206/714 |
| 6,499,595 | B1 * | 12/2002 | Petricca | 206/356 |
| 2001/0007926 | A1 | 7/2001 | Trudil | |
| 2002/0117405 | A1 * | 8/2002 | Wang et al. | 206/5.1 |
| 2002/0162758 | A1 * | 11/2002 | Clemens | 206/308.1 |

OTHER PUBLICATIONS

Photograph showing a plastic blade package produced by Crescent Mfg. Co., incorporating a plurality of blade compartments, a fold-over flap and a flap retaining band. The blade compartments are non-separable.

Photograph showing a blade encapsulated in a clear plastic package. Produced by American Safety Razor Co.

Catalog page, Cozzini Group, showing packaging for PRIMEDGE skinner blades. Un-dated and un-numbered page.

Catalog page, Cartel Cutting Equipment, Ltd., showing a type of plastic package commonly used for packaging blades. Un-dated and un-numbered page.

Pending unpublished U.S. App. No. 29/252,435, entitled "Cutting Blade Sleeve." filed by Nathan J. Abbas, et al. January 23, 2006. Drawing Figs. 1-3 are submitted herewith.

* cited by examiner

SYSTEM AND METHOD FOR PACKAGING CUTTING BLADES

FIELD

The present invention relates generally to cutting blades, in particular to a package for storing and handling cutting blades.

BACKGROUND

In the meat processing industry the productivity and overall yield of a meat processing plant depends on a number of factors, including the efficiency of the meat cutting equipment being used. The efficiency of the meat cutting equipment, in turn, varies with the sharpness of the blades utilized to cut the meat. The cutting blades have a tendency to become dull after being used for a period of time, making it necessary to regularly replace them in order to maintain the desired productivity and yield. Accordingly, meat-cutting equipment is typically designed to utilize cutting blades that can be quickly removed and replaced with new ones as the need arises.

A meat processing plant will usually keep a number of new blades on hand in order to facilitate their rapid replacement in the cutting equipment as they dull. Over time the processing plant will also typically accumulate a number of used blades that must be stored or disposed of in a safe manner. Storing and handling both new and used cutting blades can be problematic, since they pose a safety risk to workers due to their sharpness.

It is also important to store and handle new cutting blades so that they are not contaminated by incidental contact with inappropriate materials, since the blades are intended for use in food processing. A further concern is that contact of the blades with certain contaminants may cause premature blade wear or failure.

There is a need for a way to package newly-manufactured cutting blades so that they can be safely handled and transported with less risk of damage or contamination. There is a further need for a way to package used cutting blades for handling and storage.

SUMMARY

A blade package is disclosed according to an embodiment of the present invention. The blade package includes a flexible first layer having cavities formed therein. Blades are loaded into the cavities and a second, adhesive-coated flexible layer is placed over the first layer. A vacuum is drawn, urging the second layer into the cavities and holding the blades in place. A combination of heat and pressure are applied around the periphery of the cavities to activate the adhesive and form a seal that maintains the vacuum. The seal includes a chevron-shaped portion proximate a set of tabs, the tab and chevron-shaped portion cooperating to provide ease of opening the package when a blade is to be dispensed. A plurality of score lines are made between adjacent cavities, providing packets that are separable from the package and contain a single blade.

An aspect of the present invention is a flexible package for cutting blades. A flexible first layer has at least one cavity formed therein to form a base for receiving a cutting blade. A flexible second layer is arranged over the base and proximate the base. A seal is formed about the periphery of each cavity to encapsulate a cutting blade placed into the cavity, the seal being formed by applying a predetermined combination of heat and pressure to selected portions of the second layer to cause the adhesive thereon to selectively bond to the base. Movement of each encapsulated cutting blade is deterred during transport and handling by the cavity in cooperation with the seal and the second layer, the blades becoming movable within the cavity when the seal is broken.

Another aspect of the present invention is a method for making a flexible package for cutting blades. The method includes the steps of cutting a flexible first layer to a predetermined length and cutting a flexible second layer to a predetermined length, the second layer having an adhesive coating. At least one cavity is formed in the first layer to form a base. A cutting blade is placed into each cavity. The second layer is placed over the base such that the adhesive coating is proximate the base. A predetermined combination of heat and pressure is applied around the periphery of each cavity to cause the adhesive to bond together the base and the second layer, forming a seal around the cavity and encapsulating the cutting blade. Movement of each encapsulated cutting blade is deterred during transport and handling by the cavity in cooperation with the seal and the second layer, the blades becoming movable within the cavity when the seal is broken.

BRIEF DESCRIPTION OF THE DRAWINGS

Further features of the inventive embodiments will become apparent to those skilled in the art to which the embodiments relate from reading the specification and claims with reference to the accompanying drawings, in which:

DETAILED DESCRIPTION

Figure 1A:
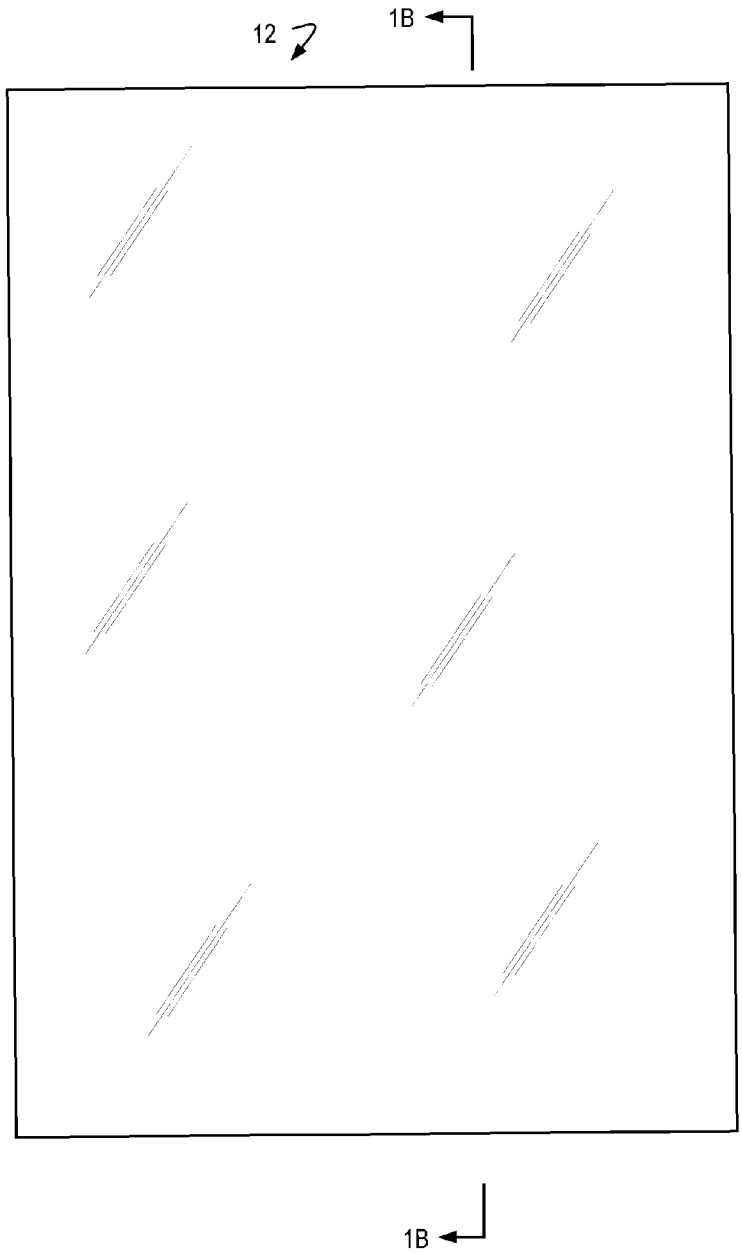
FIG. 1A is a top plan view of a first layer of a package according to an embodiment of the present invention.
Figure 1B:
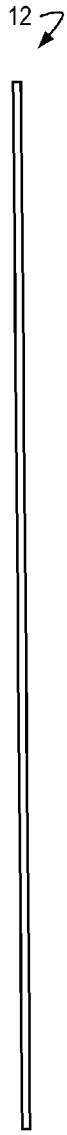
FIG. 1B is a view in section of the first layer of FIG. 1A.
Figure 2A:
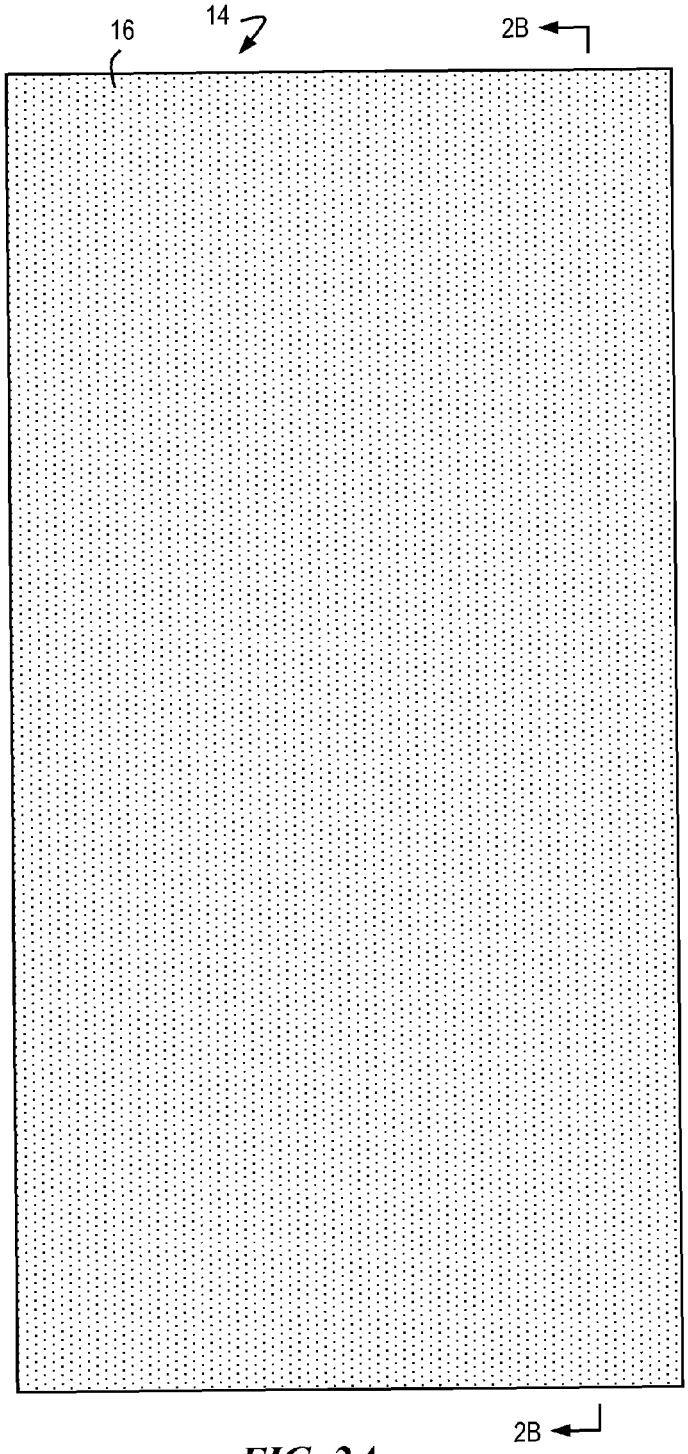
FIG. 2A is a top plan view of a second layer of a package according to an embodiment of the present invention.
Figure 2B:
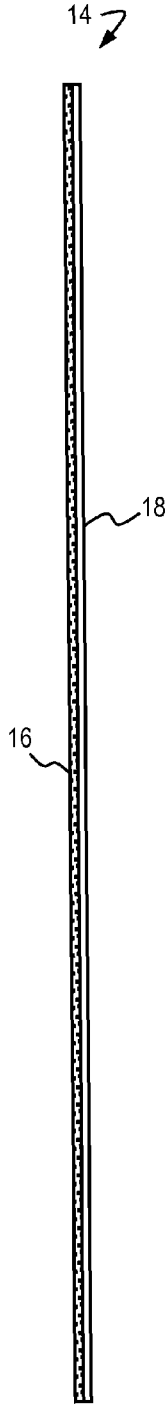
FIG. 2B is a view in section of the second layer of FIG. 2A.

Referring to FIGS. 1A, 1B, 2A and 2B a package 10 for cutting blades comprises a first layer 12 and a second layer 14. First layer 12 is a flexible, generally planar material as shown in FIGS. 1A and 1B. Second layer 14 likewise comprises a flexible, generally planar material and further includes an adhesive layer 16 that is generally uniformly applied to one entire side of a substrate 18, as shown in FIGS. 2A and 2B.

First layer 12 and substrate 18 may be made from any suitable flexible material, such as polypropylene, polyethylene and polyester. In one embodiment a low-density polyethylene (LDPE) about 0.005 inches thick is utilized. First layer 12 and substrate 18 may be clear or opaque, and may be provided in any desirable color or combination of colors, such as colors associated with a particular brand of cutting blades.

Adhesive 16 may be any type of adhesive of suitable thickness that adheres to both substrate 18 and first layer 12, serves as a moisture barrier, and exhibits suitable adhesive properties. Adhesive 16 is activated when a predetermined combination of heat and pressure is applied. Accordingly, when adhesive 16 comes into contact with first layer 12, for example, the first layer and second layer 14 will form a seal only in those areas where the requisite heat and pressure are applied. In one embodiment adhesive 16 is an aqueous-based acrylic adhesive about 0.0003 to 0.001 inches thick.

Figure 3:
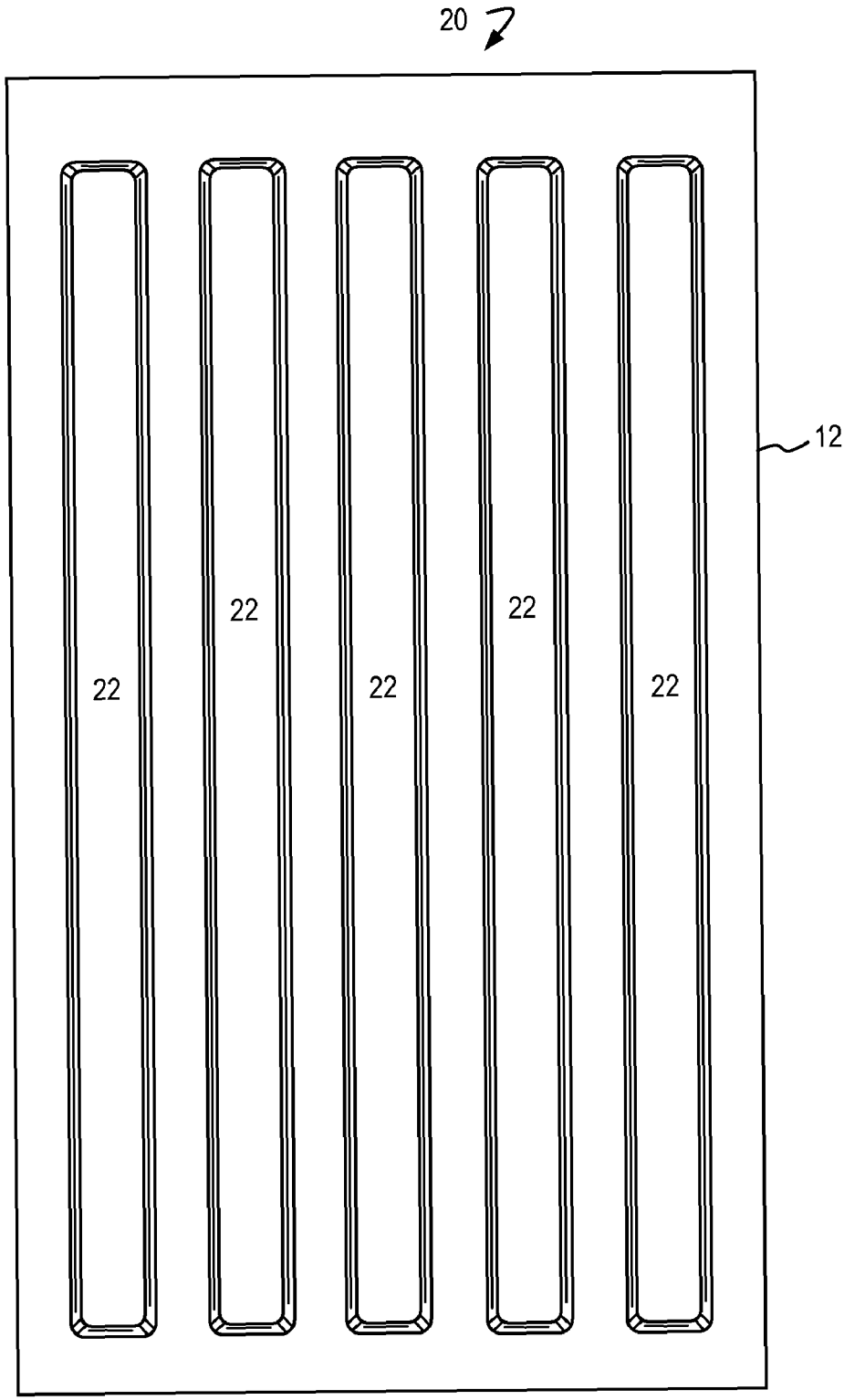
FIG. 3 is a top plan view of a base formed from the first layer of FIGS. 1A and 1B.

With reference now to FIG. 3 a base 20 is made by forming a plurality of cavities 22 in first layer 12. Cavities 22 may be formed in any conventional manner such as, without limitation, vacuum forming and molding.

Figure 4:
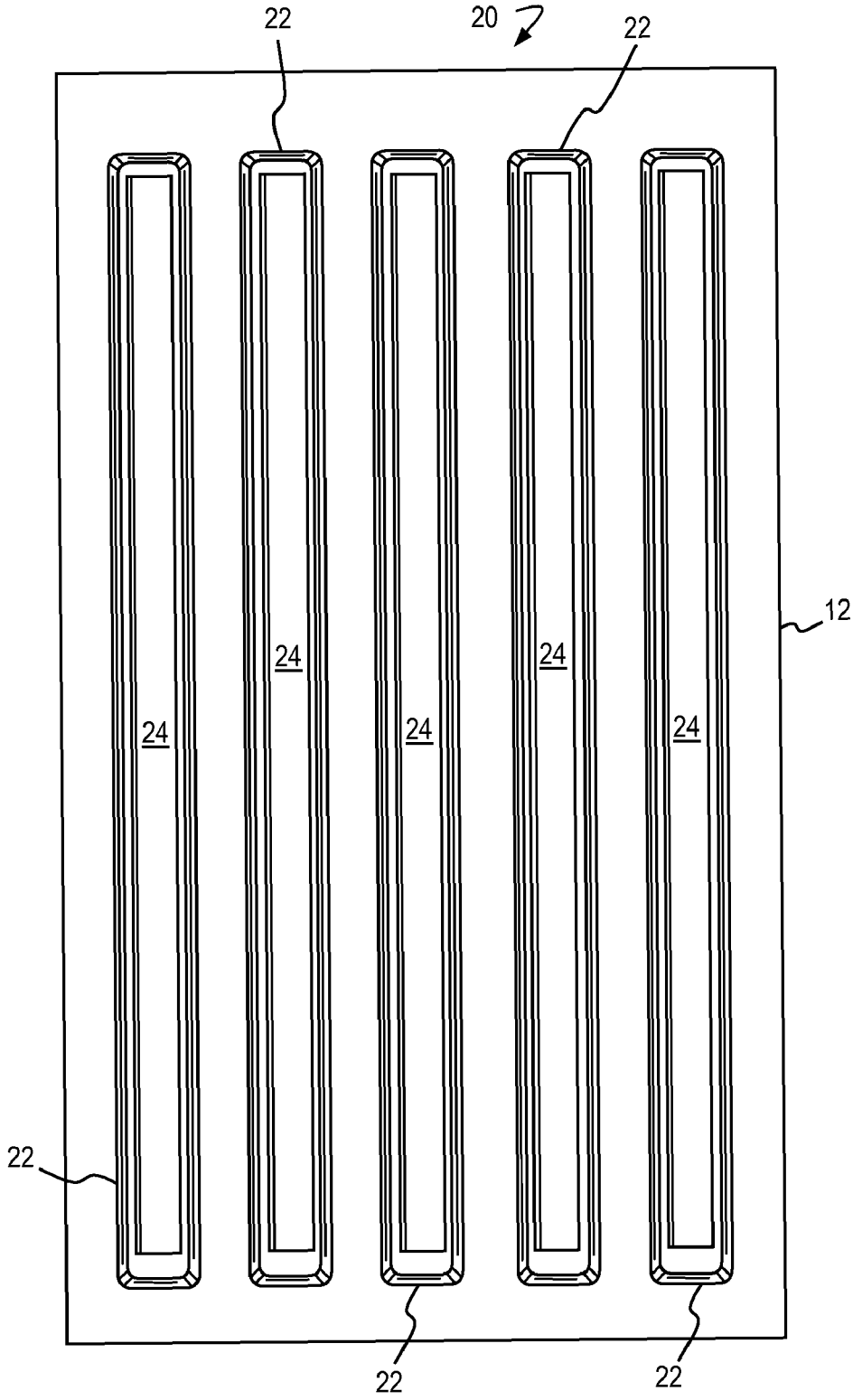
FIG. 4 shows the base of FIG. 3 with blades loaded into the cavities.
Figure 5:
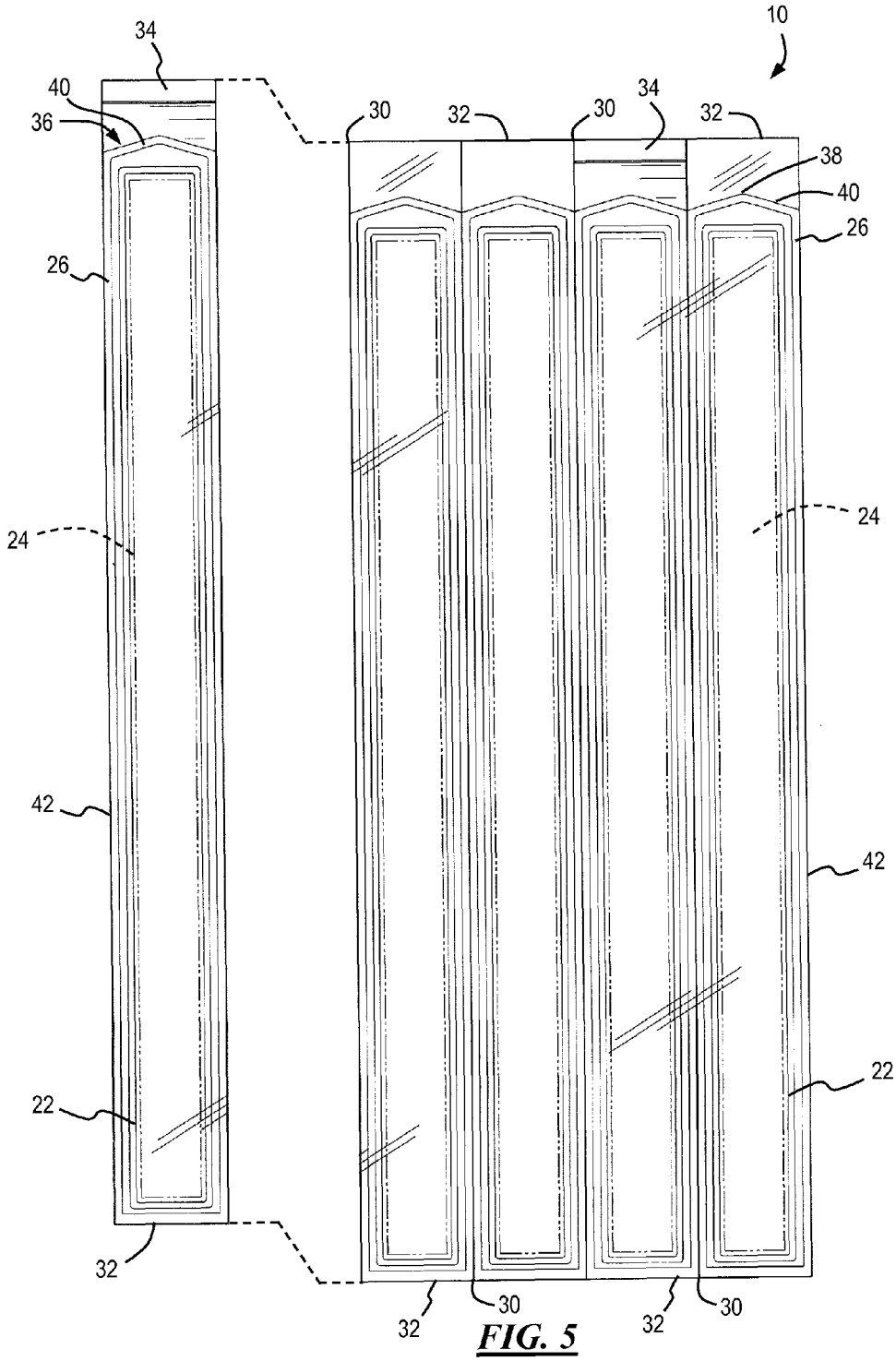
FIG. 5 is a top plan view of a blade package according to an embodiment of the present invention.

Package 10 is assembled by first placing articles to be packaged, such as a set of cutting blades 24, into cavities 22 of base 20 as shown in FIG. 4. Second layer 14 is then arranged over base 20 and placed proximate thereto such that adhesive 16 comes into contact with the base. A predetermined combination of heat and pressure is then applied in selected areas, such as around the periphery of cavities 22, causing adhesive 16 to bond with base 20 to form a seal 26 around the cavities as shown in FIG. 5 and encapsulate the blades 24 therein. Seal 26 may be formed in any conventional manner, such as with a heated platen or die. In addition, the heated platen or die may have a predetermined patterning 28, such as the cross-hatched patterning shown in FIG. 6, to increase the effective bonding area of seal 26.

Figure 6:
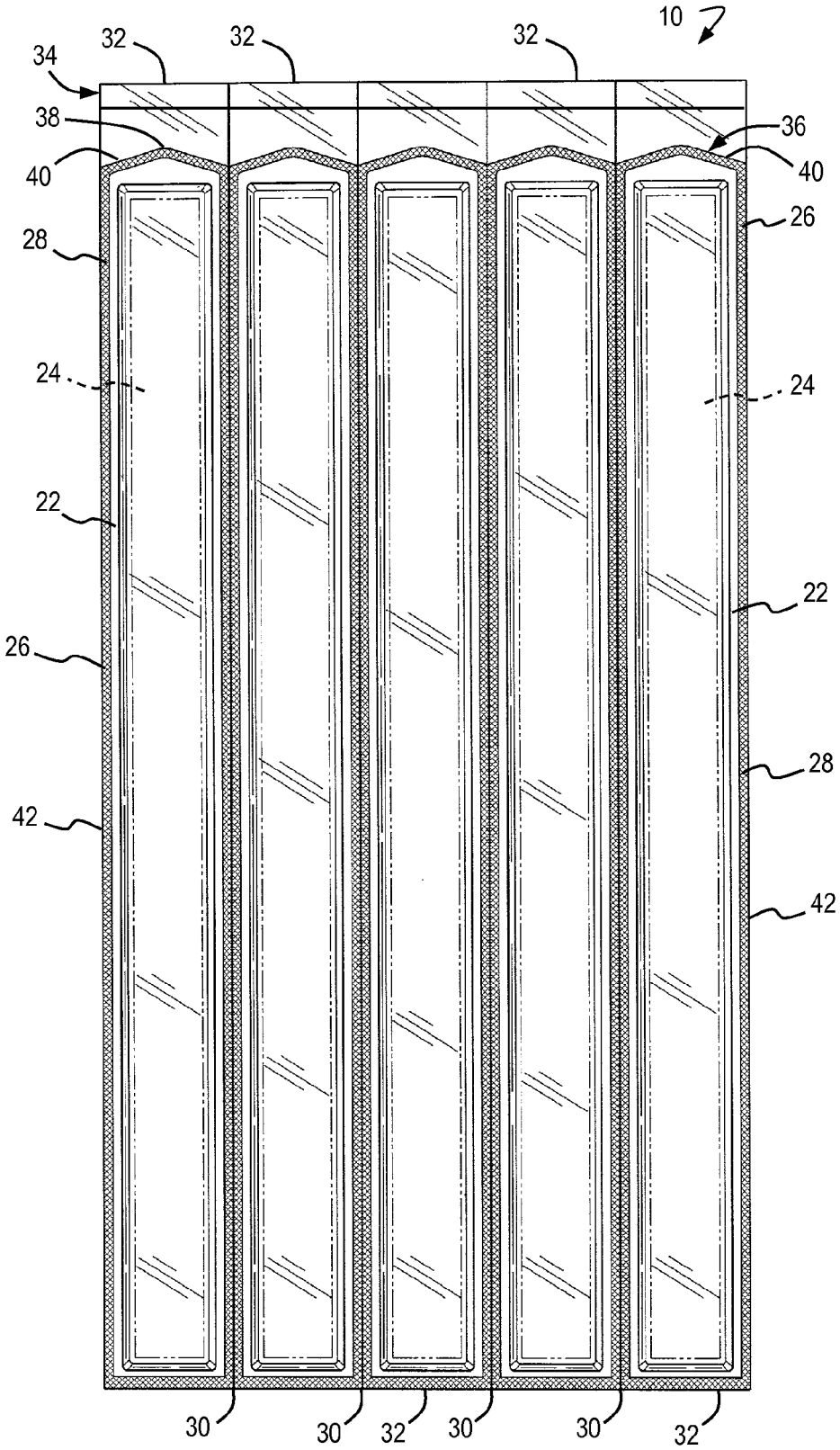
FIG. 6 is a top plan view of a blade package according to another embodiment of the present invention.
Figure 7:
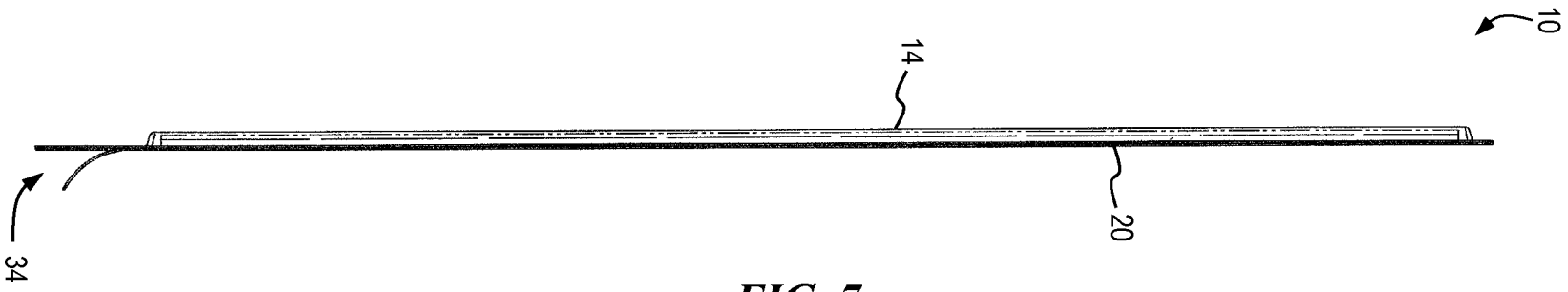
FIG. 7 is a side elevational view of the packages of FIGS. 5 and 6.
Figure 8:
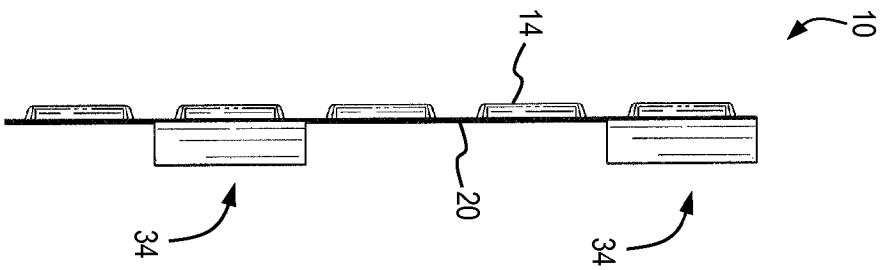
FIG. 8 is an end elevational view of the packages of FIGS. 5 and 6.

A plurality of longitudinal perforations or score lines 30 may be placed between adjacent cavities 22 as shown in FIGS. 5 and 6. Score lines 30 form a plurality of packets 32, each containing a blade 24. If desired, a user may separate one or more packets 32 from package 10 by tearing along selected score lines 30.

In some embodiments of the present invention a transverse edge of package 10 may be formed with tabs 34, as shown in FIGS. 5, 7, 8 and 9. Tabs 34 are formed by corresponding portions of base 20 and second layer 14 that are not adhered together by adhesive 16. These areas are not exposed to the heat and/or pressure utilized to form seal 26, thereby remaining separated from each other. Tabs 34 facilitate opening of package 10 when a blade 24 is to be dispensed therefrom.

In other embodiments of the present invention a vacuum is applied to cavities 22 and the space between base 20 and second layer 14. The vacuum causes second layer 14 to be urged into cavities 22 and into intimate contact with first layer 12 and blades 24. Seal 26 is then formed in the manner previously described to maintain the vacuum in the cavities. The vacuum seal deters movement of blades 24 encapsulated in cavities 22, thereby reducing the risk of damage to package 10 by the blades due to their movement during transport and handling, which could cause contamination of the blades and pose a safety risk to personnel transporting and handling the package. This has an added advantage in that the blades in the package need not be arranged irregularly such that their cutting edge faces the center of the package, as is commonly done at present for safety reasons. The vacuum seal is also expected to aid in the extension of the shelf life of carbon-type blades 24 by deterring oxidation.

Package 10 may include printed matter on base 20 and/or second layer 14. The printed matter may include, without limitation, brand names, trademarks, handling instructions, manufacturing data, date codes, expiration dates, and so on.

Blades 24 may be disinfected prior to or during packaging, if desired. For example, blades 24 may be dipped, sprayed or exposed to a disinfectant gas prior to loading into cavities 22. In other embodiments of the present invention a disinfectant gas may be injected into cavities 22 after blades 24 are loaded into base 20, prior to sealing or vacuum-sealing in the manner previously described.

Figure 9:
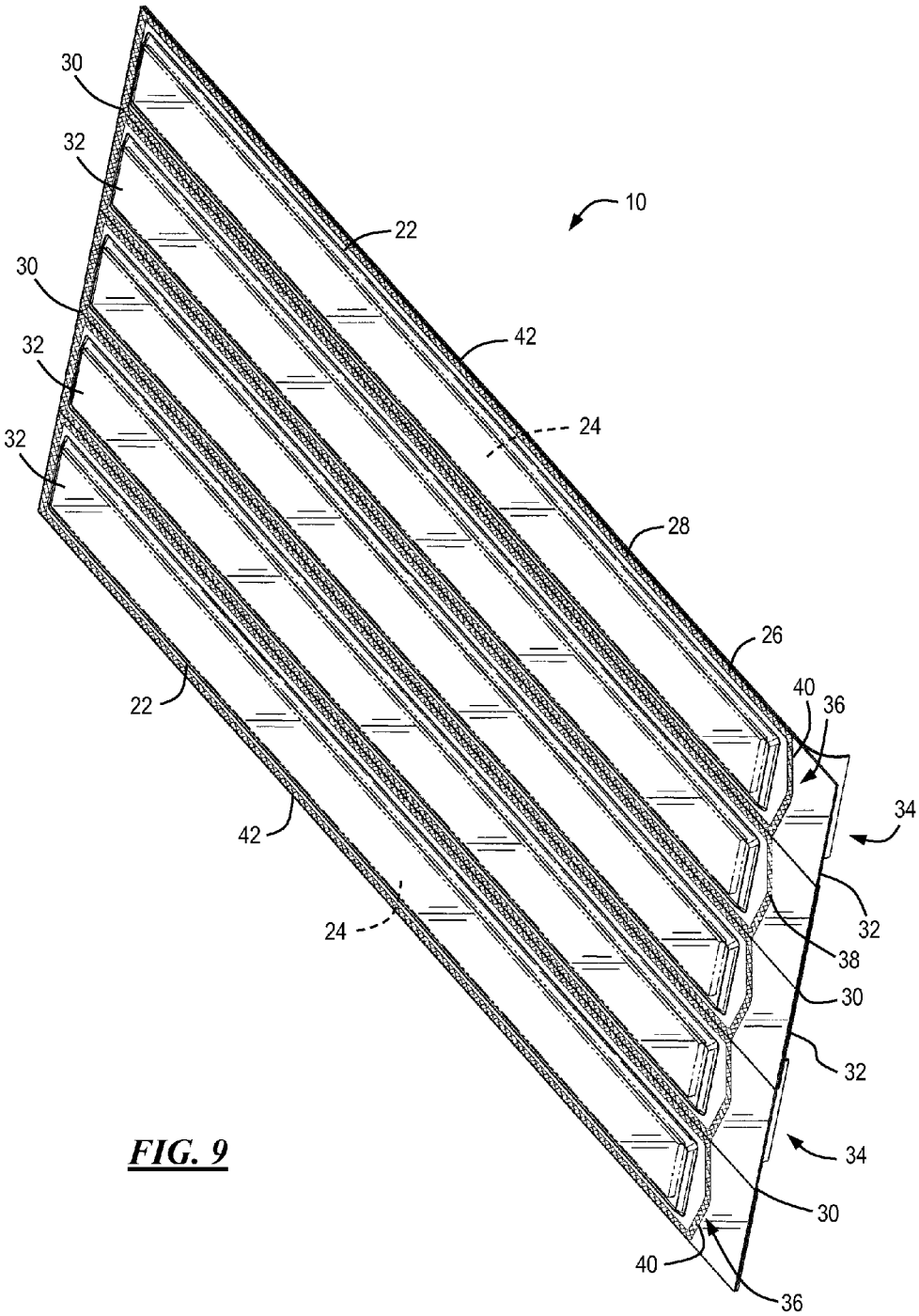
FIG. 9 shows the general arrangement of a package according to an embodiment of the present invention.

In still other embodiments seal 26 may further include a chevron shape 36 proximate tabs 34, as shown in FIGS. 5, 6 and 9. Chevron shape 36 causes seal 26 to begin separating at an apex 38 of the chevron shape when tabs 34 are pulled away from each other by a user to dispense a blade from package 10. As the user continues to pull on tabs 36 the seal 26 will continue separating along arms 40 of the chevron-shaped seal portion 36, thereby exposing a blade 24 for dispensing. When the blade is thus exposed any vacuum present in the selected cavity 22 is released, causing the cavity to expand slightly. This allows a blade 24 packaged therein to move slidably for dispensing from between the now partially separated base 20 and second layer 14.

In some embodiments of the present invention adhesive 16 may be a re-sealable type. In such embodiments seal 26 may be re-sealed by aligning the separated portions of seal 26 on base 20 and second layer 14, then pressing them together. This permits cavities 22 of package 10 and/or packets 32 to receive used blades and then be re-sealed for subsequent handling, transport and disposal.

After package 10 is assembled it may be cut to a desired longitudinal length to provide a finished, uniform appearance. Package 10 may be cut in any conventional manner, such as manually with knives or razor blades, or automatically with rotary cutting wheels and knives. Likewise, the outer longitudinal edges 42 of package 10 may be trimmed to provide a uniform aesthetic appearance. The outer longitudinal edges 42 may be trimmed in any conventional manner, such as manually, with knives or razor blades, or automatically with rotary cutting wheels and knives.

Figure 10:
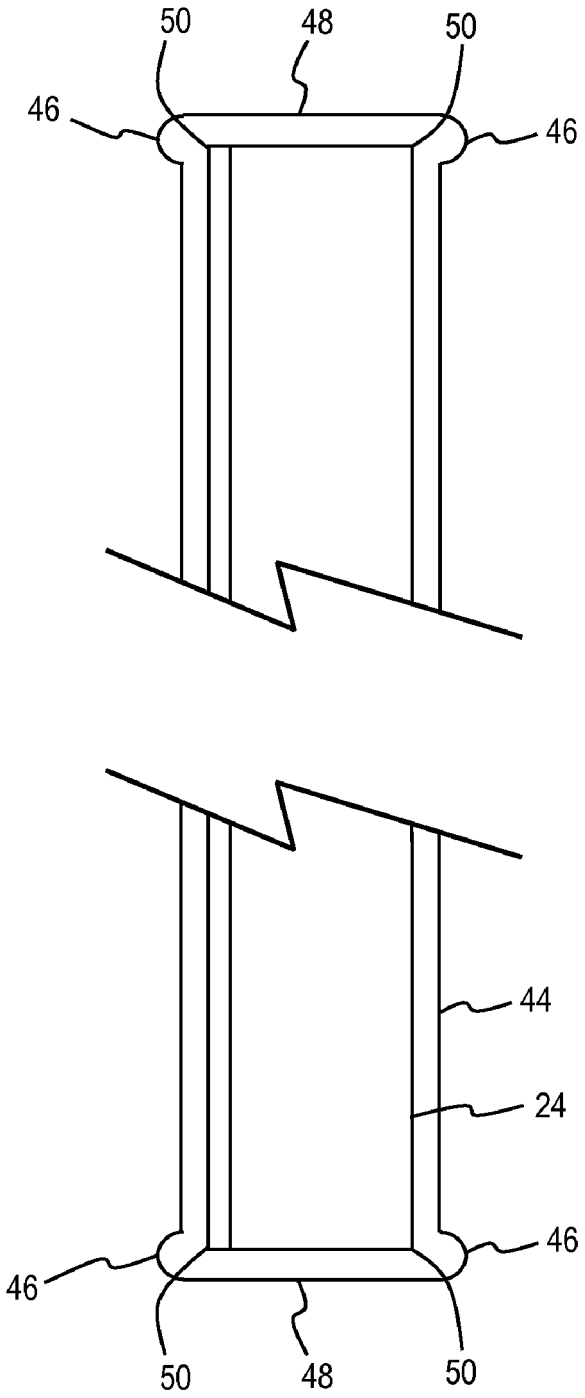
FIG. 10 shows details of a cavity for a blade package according to yet another embodiment of the present invention.

In one embodiment of the present invention base 20 may include one or more cavities 44, shown in FIG. 10. Cavity 44 includes at least one corner relief 46 proximate at least one longitudinal end 48 of the cavity. Reliefs 46 aid to prevent corners 50 of blades 24 from piercing package 10 (see generally FIG. 4) by providing a gap between the corners and the edges that delimit cavity 44. Cavity 44 is otherwise identical in structure and function to cavity 22 and thus will not be reiterated here. Likewise, base 20 (and, in turn, package 10) may be formed with one or more of cavities 22 or cavities 44, or may be formed with one or more of cavities 22 and cavities 44.

In another embodiment of the present invention adhesive 16 may be omitted from second layer 14. In this embodiment seal 26 is formed by causing first layer 12 and second layer 14 to bond together by melting and form a seal only in those areas where the requisite heat and pressure are applied. Seal 26 may be formed in any conventional manner, such as with a heated platen or die. In addition, the heated platen or die may have a predetermined patterning 28, such as the cross-hatched patterning shown in FIG. 6, to increase the effective bonding area of seal 26. Alternatively, an ultrasonic welder may be used to bond second layer 14 to first layer 12.

With reference to FIGS. 1-10 together, in use package 10 allows blades 24 to be safely stored and transported to their ultimate point of use, such as a meat processing plant. When a blade 24 is needed a user may separate a selected packet 32 from package 10 by tearing along a corresponding score line 30. The user pulls tabs 34 away from each other, causing seal 26 to begin separating at apex 38 of its chevron-shaped portion 36. As the user continues to pull on tabs 34 the seal 26 will continue separating along arms 40 of the chevron-shaped seal portion 36, thereby exposing a blade 24 for dispensing. When the blade is thus exposed any vacuum present in the selected cavity 22, 44 is released, causing the cavity to expand slightly. This allows a blade 24 packaged therein to move slidably for dispensing from between the now partially separated base 20 and second layer 14. Thereafter a used blade 24 may be loaded into packet 32 for subsequent handling, transport and disposal. If a re-sealable type of adhesive 16 is present, seal 26 may be re-sealed by aligning the separated portions of the seal on base 20 and second layer 14, then pressing them together.

Figure 11:
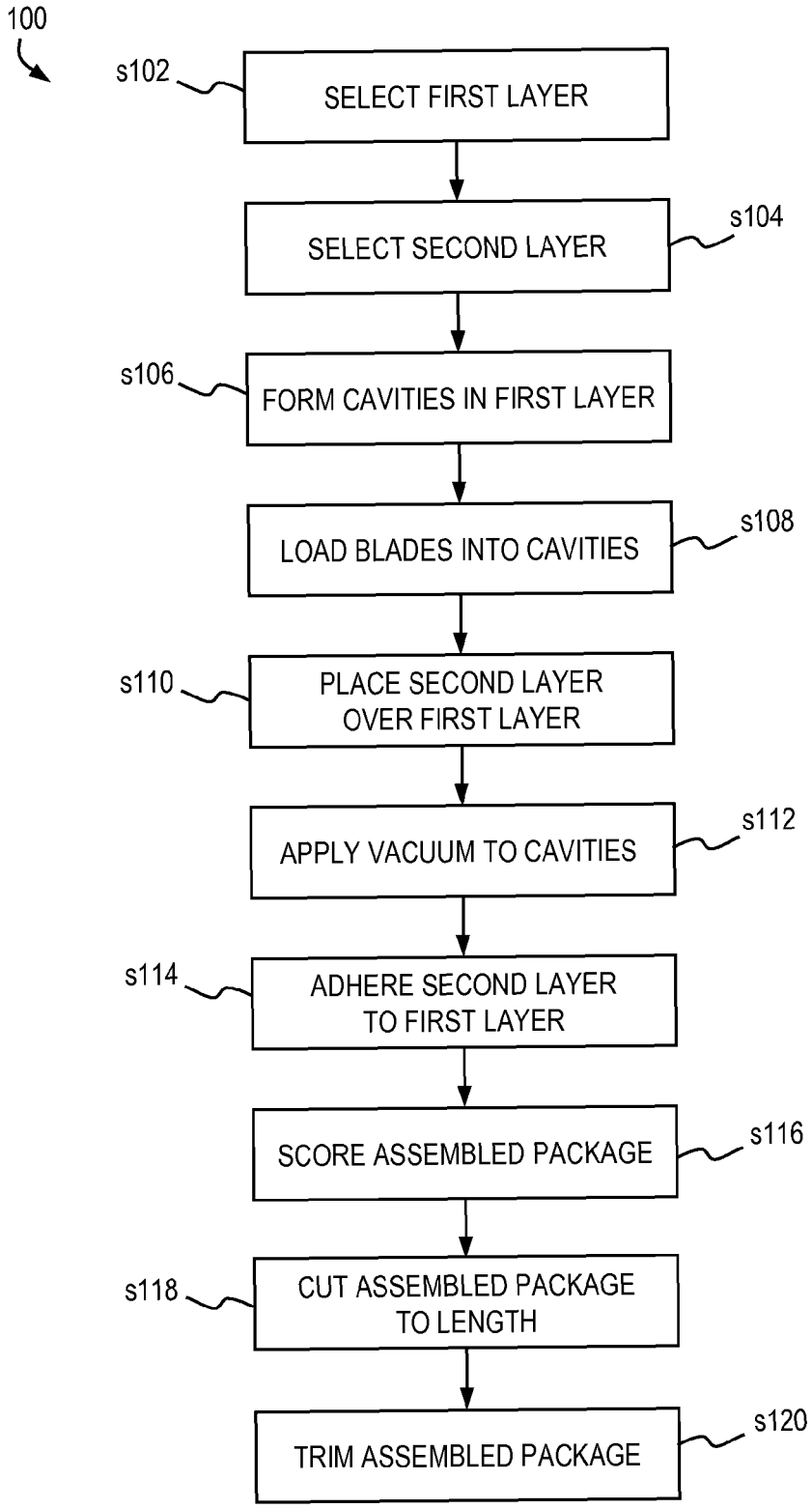
FIG. 11 shows steps of a method for packaging articles according to an embodiment of the present invention.

With general reference to FIGS. 1-10 together a method 100 for making a blade package is shown in FIG. 11 according to an embodiment of the present invention. At step s102 a first layer 12 is selected. At step s104 a second layer 14 is likewise selected. In some embodiments first layer 12 and second layer 14 may each be provided in a continuous web and unrolled or indexed to a predetermined selected length for further processing, as detailed below.

At step s106 a predetermined number of cavities 22, which may be one or more than one, are formed in first layer 12 to form base 20, the cavities each having a shape and depth to receive a corresponding blade 24. Cavities 22 may be formed in any conventional manner such as, without limitation, vacuum forming using heated dies.

At step s108 blades 24 are loaded into corresponding cavities 22. Blades 24 may be loaded into cavities 22 in any conventional manner including, without limitation, manually and with robotic pick-and-place mechanisms.

At step s110 second layer 14 is placed over base 20 in any conventional manner such as, without limitation, manually, roll feeders and robotic pick-and-place mechanisms. Second layer 14 is positioned such that adhesive coating 16 is proximate base 20.

At step s112 a vacuum is applied to cavities 22 and the space between base 20 and second layer 14. The vacuum causes second layer 14 to be urged into cavities 22 and into contact with base 20.

At step s114 a predetermined combination of heat and pressure are applied to the assembly of base 20, blades 24 and second layer 14. The heat and pressure cause adhesive 16 to bond second layer 14 to base 20 in selected areas, thereby forming a plurality of seals 26. Seals 26 are preferably formed as an unbroken perimeter around each cavity 22, thereby maintaining a vacuum seal in the cavities to resist movement of encapsulated blades 24 in the cavities.

At step s116 a plurality of longitudinal perforations or score lines 30 are made between adjacent cavities 22. The score lines may be made in any conventional manner including, without limitation, razors and scoring wheels. Score lines 30 facilitate the later separation of package 10 into one or more packets 32.

At step s118 package 10 may be cut to a desired longitudinal length to provide a finished, uniform appearance. Package 10 may be cut in any conventional manner, such as manually with knives or razor blades, or automatically with rotary cutting wheels and knives. Likewise, at step s120 the outer longitudinal edges 42 of package 10 may be trimmed to provide a uniform aesthetic appearance. The outer longitudinal edges 42 may be trimmed in any conventional manner, such as manually with knives or razor blades, or automatically with rotary cutting wheels and knives.

While this invention has been shown and described with respect to a detailed embodiment thereof, it will be understood by those skilled in the art that changes in form and detail thereof may be made without departing from the scope of the claims of the invention. For example, although the packaging system and method disclosed herein are directed to packaging blades, it is understood that the system and method may be easily adapted to package a wide variety of articles within the scope of the invention. In addition, the order of the steps discussed above may be varied within the scope of the invention.

What is claimed is:

1. A flexible package for cutting blades, comprising:

a generally planar flexible first layer;

a base comprising at least one generally planar, generally rectangularly-shaped cavity formed in the first layer, the cavity including a pair of spaced-apart longitudinal edges and a pair of spaced-apart lateral edges, the longitudinal edges each having a pair of ends spaced apart from the lateral edges and the lateral edges each having a pair of ends extending beyond intersecting points of the longitudinal and lateral edges;

a plurality of arcuate portions formed in the base and integral to the cavity, the arcuate portions extending between proximate ends of the longitudinal edges and the lateral edges of the cavity;

a generally planar flexible second layer arranged over the base and proximate the base; and a seal formed about the periphery of each cavity to encapsulate a cutting blade placed into the cavity, the seal being formed by applying a predetermined combination of heat and pressure to selected portions of the second layer to cause the second layer to selectively bond to the base while a vacuum is applied to the cavity, the seal maintaining the vacuum, the vacuum drawing the first and second layers toward one another within the cavity to confront and contact opposing sides of the blade, thereby immobilizing the blade in the cavity, wherein movement of each encapsulated cutting blade is deterred during transport and handling by the vacuum, the blades becoming movable within the cavity when the seal is broken.

2. The package of claim 1 wherein the second layer further includes an adhesive coating, the second layer being arranged over the base such that the adhesive coating is proximate the base.

3. The package of claim 1 wherein the seal further comprises a chevron-shaped portion.

4. The package of claim 1 wherein the seal further comprises a predetermined patterning.

5. The package of claim 1 wherein the seal forms a moisture barrier.

6. The package of claim 1, further comprising a tab formed at a transverse edge of the package.

7. The package of claim 1, further comprising a longitudinal score line between adjacent cavities to facilitate separation of the package into a plurality of packets.

8. The package of claim 1, further comprising a pair of trimmed longitudinal outer edges.

9. The package of claim 1, further comprising printed matter on one of the base and the second layer.

10. The package of claim 2 wherein the adhesive is a re-sealable type of adhesive.

11. The package of claim 1, further comprising a disinfectant applied to at least one of the cutting blade and the cavity.

12. A flexible package for cutting blades, comprising:

a generally planar flexible first layer;

a base comprising a plurality of generally planar, generally rectangularly-shaped cavities formed in the first layer, the cavities each including a pair of spaced-apart longitudinal edges and a pair of spaced-apart lateral edges, the longitudinal edges each having a pair of ends spaced apart from the lateral edges and the lateral edges each having a pair of ends extending beyond intersecting points of the longitudinal and lateral edges;

a plurality of arcuate portions formed in the base and integral to the cavities, the arcuate portions extending between proximate ends of the longitudinal edges and the lateral edges of the cavities;

a generally planar flexible second layer having an adhesive coating, the second layer being arranged over the base such that the adhesive coating is proximate the base;

a plurality of seals formed about the periphery of corresponding cavities to encapsulate cutting blades placed into the cavities, the seals being formed by applying a predetermined combination of heat and pressure to selected portions of the second layer to cause the adhesive thereon to selectively bond to the base while a vacuum is applied to the cavities, the seals maintaining the vacuum, the vacuum drawing the first and second layers toward one another within the cavity to confront and contact opposing sides of the blades, thereby immobilizing the blades in the cavities, each seal having a predetermined patterning and a chevron-shaped portion including an apex and a pair of arms extending therefrom;

a longitudinal score line between adjacent cavities to facilitate separation of the package into a plurality of packets;

tabs formed at a transverse edge of the package; and a pair of trimmed longitudinal outer edges, wherein movement of the encapsulated cutting blades is deterred during transport and handling by the vacuum, the blades becoming movable within the cavities when the seals are broken, and wherein the blades are removable from the package when the seal is separated at the apex and the arms of the chevron-shaped portion.

* * * * *